US009672771B2

(12) United States Patent
Goden et al.

(10) Patent No.: US 9,672,771 B2
(45) Date of Patent: Jun. 6, 2017

(54) LIGHT-EMITTING DEVICE AND IMAGE FORMING APPARATUS

(71) Applicant: CANON KABUSHIKI KAISHA, Tokyo (JP)

(72) Inventors: Tatsuhito Goden, Machida (JP); Kiyofumi Sakaguchi, Miura-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/818,732

(22) Filed: Aug. 5, 2015

(65) Prior Publication Data

US 2016/0042688 A1 Feb. 11, 2016

(30) Foreign Application Priority Data

Aug. 11, 2014 (JP) ..... 2014-163369

(51) Int. Cl.
*B41J 2/385* (2006.01)
*G09G 3/3233* (2016.01)
*G03G 15/04* (2006.01)

(52) U.S. Cl.
CPC ..... *G09G 3/3233* (2013.01); *G03G 15/04054* (2013.01); *G09G 2300/0819* (2013.01); *G09G 2300/0861* (2013.01); *G09G 2310/0251* (2013.01); *G09G 2310/0262* (2013.01); *G09G 2320/0223* (2013.01); *G09G 2320/043* (2013.01)

(58) Field of Classification Search
CPC ..... G09G 3/3233; G09G 3/3225; G09G 2310/0256; G09G 2310/0251; G09G 2320/043; G09G 2300/0819; G09G 2300/0866; G03G 15/04054
See application file for complete search history.

(56) References Cited

U.S. PATENT DOCUMENTS 6,107,994 A 8/2000 Harada et al.
6,800,871 B2 10/2004 Matsuda et al.
7,605,899 B2 10/2009 Shikina et al.
7,812,812 B2 10/2010 Yoshinaga et al.
(Continued)

FOREIGN PATENT DOCUMENTS

JP 2009-006718 A 1/2009

*Primary Examiner* — Marc Armand
*Assistant Examiner* — Sue Tang
(74) *Attorney, Agent, or Firm* — Fitzpatrick, Cella, Harper & Scinto

(57) ABSTRACT

The present invention provides a light-emitting device including a pixel block including light-emitting elements disposed on a long substrate and aligned in the longitudinal direction of the substrate, pixel circuits connected to the light-emitting elements, a control signal line connected to the pixel circuits, and a pixel block select circuit connected to the control signal line and configured to output a control signal to the pixel circuits. The pixel circuits are divided into a plurality of groups. The control signal line includes first and second interconnection portions. The first interconnection portion is disposed along the longitudinal direction of the substrate and connected to the pixel circuits. The second interconnection portion is disposed in a region between the groups and connected to the pixel block select circuit. The first interconnection portion and the second interconnection portion are connected to each other in the region between the groups.

7 Claims, 6 Drawing Sheets

(56) References Cited

U.S. PATENT DOCUMENTS

| | | | | |
|---|---|---|---|---|
| 7,911,425 | B2 | 3/2011 | Goden et al. | |
| 7,982,694 | B2 * | 7/2011 | Ogura | G09G 3/3233 345/76 |
| 8,339,336 | B2 | 12/2012 | Goden et al. | |
| 8,354,981 | B2 | 1/2013 | Kawasaki et al. | |
| 8,395,570 | B2 | 3/2013 | Maru et al. | |
| 8,436,841 | B2 | 5/2013 | Maru et al. | |
| 8,830,147 | B2 | 9/2014 | Shikina et al. | |
| 8,847,934 | B2 | 9/2014 | Yamashita et al. | |
| 9,012,949 | B2 * | 4/2015 | Yamazaki | H01L 51/524 257/100 |
| 2003/0222334 | A1 | 12/2003 | Ikeda et al. | |
| 2009/0002473 | A1 | 1/2009 | Kitazawa | |
| 2010/0328365 | A1 | 12/2010 | Ikeda et al. | |
| 2012/0086742 | A1 | 4/2012 | Ikeda et al. | |

* cited by examiner

LIGHT-EMITTING DEVICE AND IMAGE FORMING APPARATUS

BACKGROUND OF THE INVENTION

Field of the Invention

The present invention relates to a light-emitting device and an image forming apparatus.

Description of the Related Art

In recent years, image forming apparatuses have been developed which use, as exposure means, a line head with many organic electroluminescence elements (hereinafter, referred to as "organic EL elements") disposed in one line. This line head includes the plurality of organic EL elements and a plurality of pixel circuits including transistors for driving these organic EL elements. The luminance of each organic EL element is controlled by controlling the amount of current to be flowed into the organic EL element by means of the corresponding pixel circuit.

Japanese Patent Application Laid-Open No. 2009-006718 discloses a line head using organic EL elements disposed in a line. The line head described in Japanese Patent Application Laid-Open No. 2009-006718 is such that a plurality of pixels disposed in a line are divided into a plurality of pixel blocks, and data signals are supplied in a time-division manner to pixel circuits connected to the pixels while the pixel blocks are sequentially selected by means of control signals from a shift register.

In Japanese Patent Application Laid-Open No. 2009-006718, the control signals for sequentially selecting the pixel blocks are each inputted as a common signal to all the pixel circuits in the pixel block. When the control signal is inputted into the pixel circuit at an end of the pixel block, the control signal travels through a control signal line and is inputted into the adjacent pixel circuit. The control signal is then inputted sequentially into the following adjacent pixel circuits, and the control signal is eventually supplied to all the pixel circuits in the pixel block.

Here, as the control signal travels through the control signal line, the waveform of the control signal is gradually deformed due to the parasitic impedance of the interconnection line such that the waveform is different between the first pixel circuit the control signal is inputted and the last pixel circuit the control signal is inputted. Such a difference influences the writing of a data signal to each pixel circuit and makes it difficult to accurately control the amount of current to be flowed into each organic EL element.

The influence of the deformation of the waveform of the control signal as described above occurs not only on light-emitting devices using organic EL elements but similarly on light-emitting devices using other light-emitting elements such for example as inorganic EL elements, e.g., light-emitting diodes (LEDs).

SUMMARY OF THE INVENTION

An object of the present invention is to provide a light-emitting device accurately controlling the amount of current to be flowed to each light-emitting element by reducing the deformation of the waveforms of control signals, and also to provide an image forming apparatus with such a light-emitting device capable of fine image formation.

According to one aspect of the present invention, there is provided a light-emitting device including a pixel block including a plurality of light-emitting elements disposed on a long substrate and aligned in a longitudinal direction of the substrate, a plurality of pixel circuits connected to the plurality of light-emitting elements, respectively, a control signal line connected to the plurality of pixel circuits, and a pixel block select circuit connected to the control signal line and configured to output a control signal to the plurality of pixel circuits, in which the plurality of pixel circuits are divided into a plurality of groups, the control signal line includes a first interconnection portion and a second interconnection portion, the first interconnection portion is disposed along the longitudinal direction of the substrate and connected to the plurality of pixel circuits, the second interconnection portion is disposed in a region between the plurality of groups and connected to the pixel block select circuit, and the first interconnection portion and the second interconnection portion are connected to each other in the region between the plurality of groups.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

Figure 1:
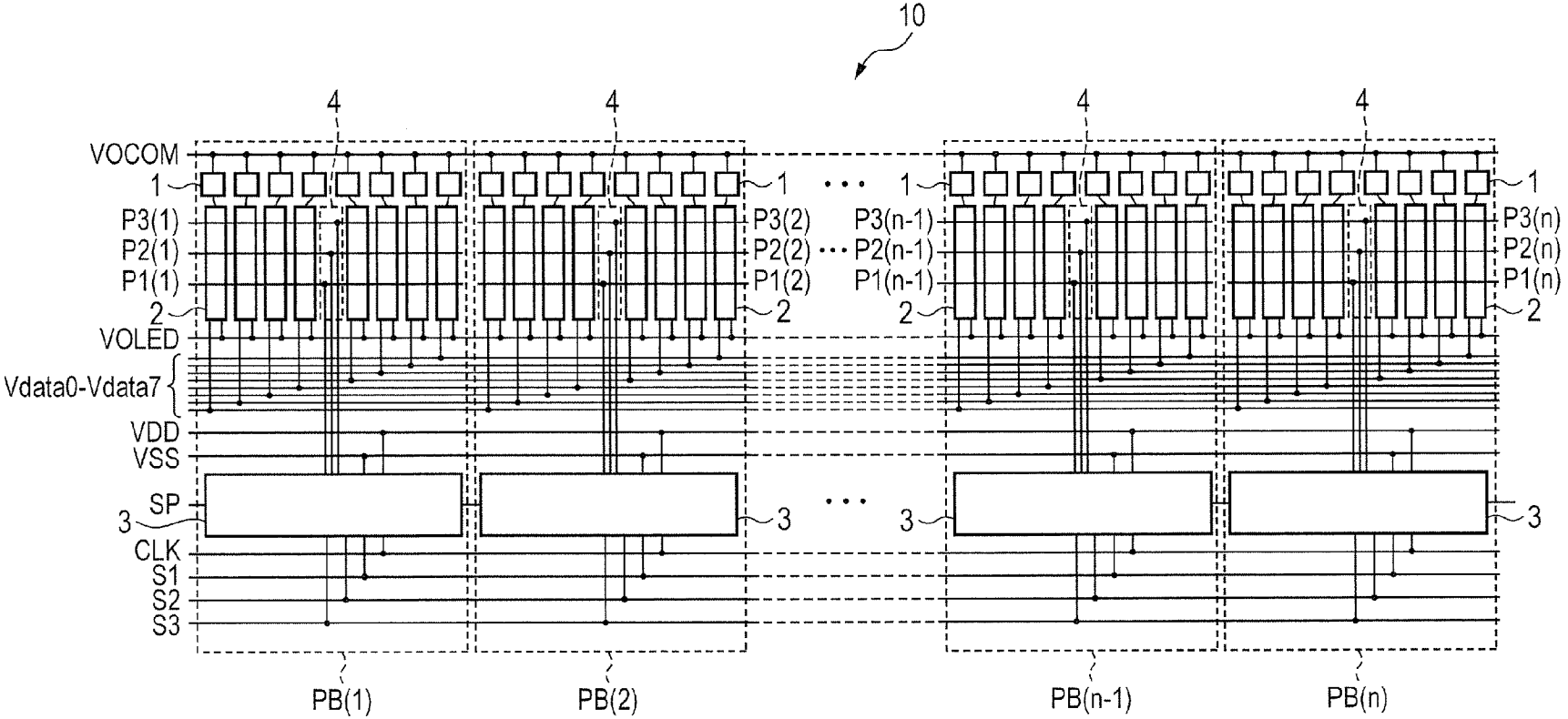
FIG. 1 is a schematic diagram illustrating the configuration of a light-emitting device according to a first embodiment of the present invention.
Figure 2:
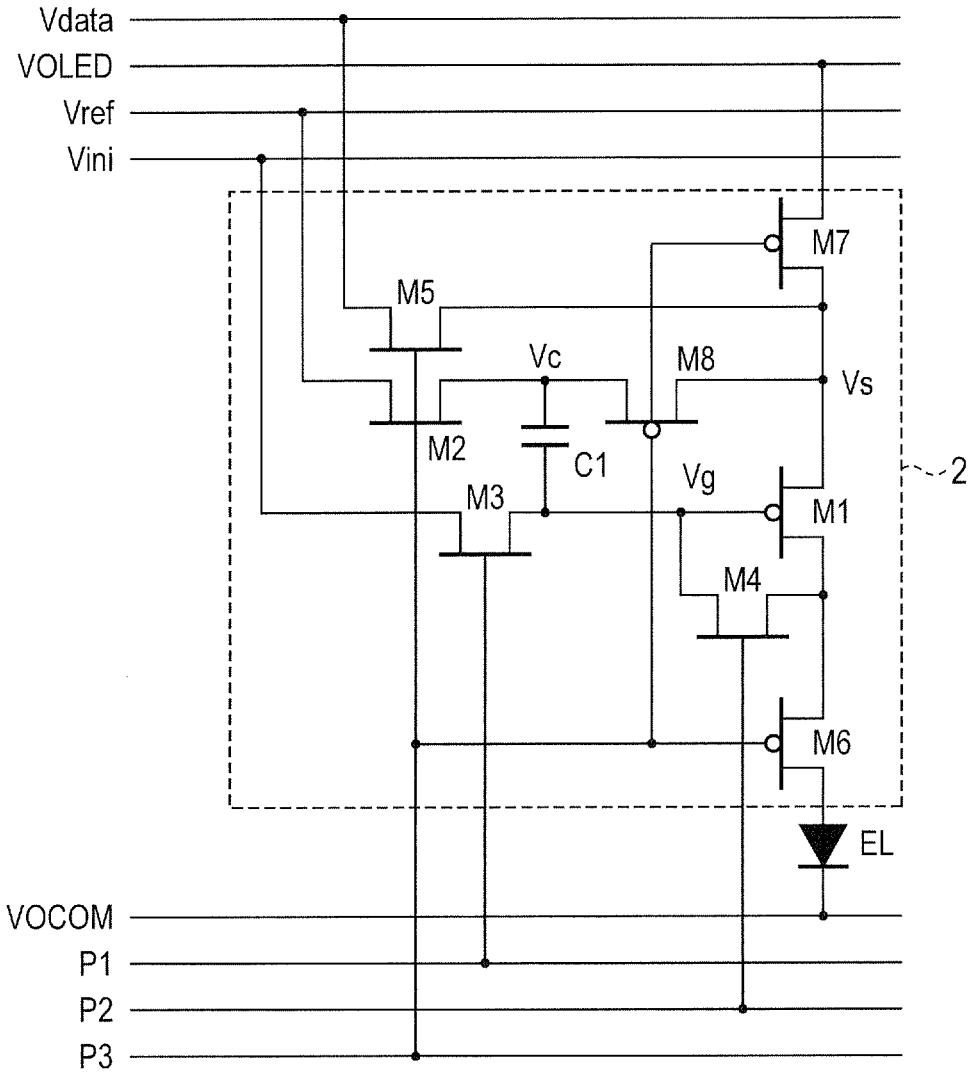
FIG. 2 is a circuit diagram illustrating an example of a pixel circuit in the light-emitting device according to the first embodiment of the present invention.
Figure 3:
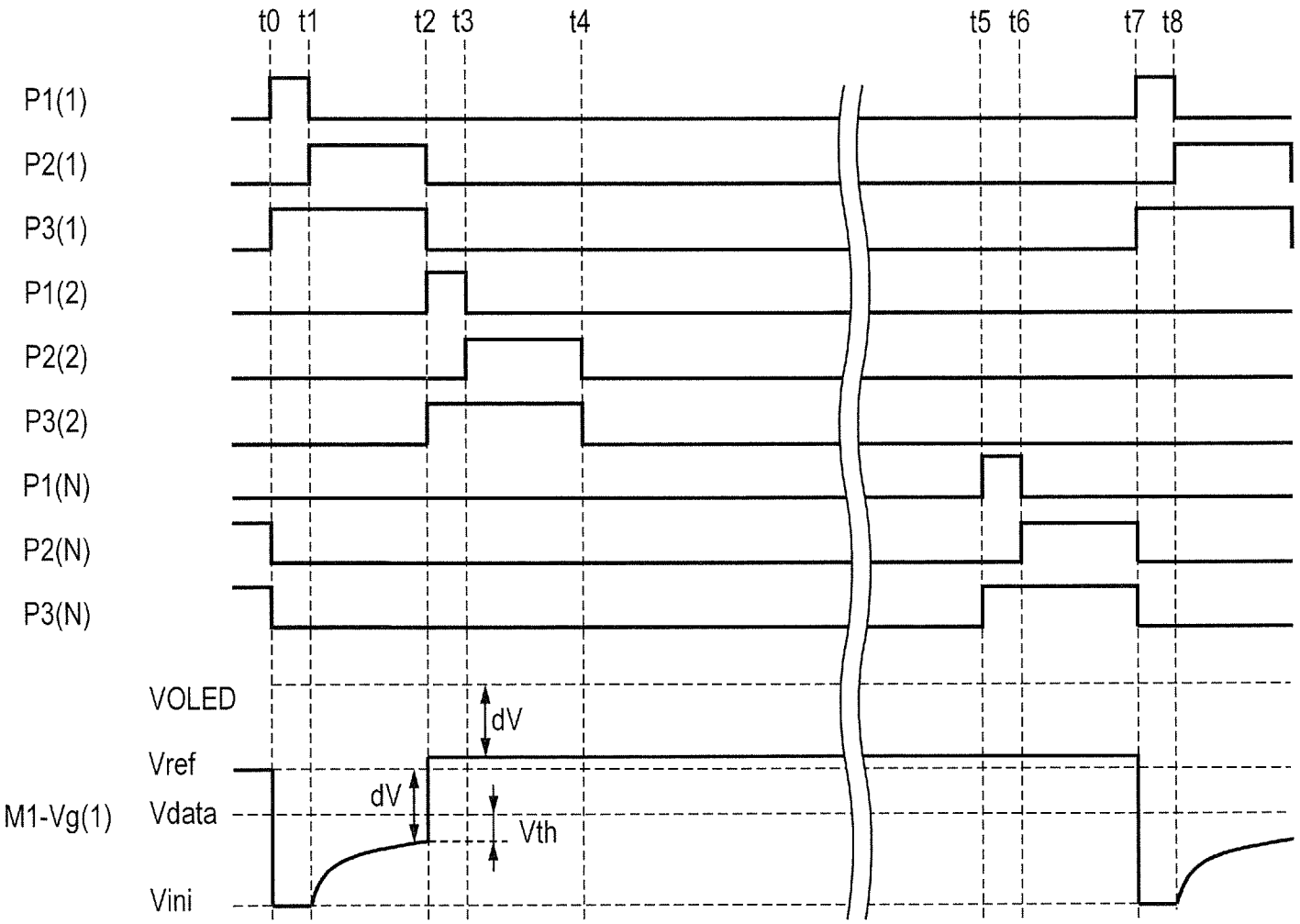
FIG. 3 is a timing chart illustrating the operation of the light-emitting device according to the first embodiment of the present invention.

A light-emitting device according to a first embodiment of the present invention will be described with reference to FIGS. 1 to 3. FIG. 1 is a schematic diagram illustrating the configuration of the light-emitting device according to the present embodiment. FIG. 2 is a circuit diagram illustrating an example of a pixel circuit in the light-emitting device according to the present embodiment. FIG. 3 is a timing chart illustrating the operation of the light-emitting device according to the present embodiment.

First, the configuration of the light-emitting device according to the present embodiment will be described with reference to FIGS. 1 and 2.

The light-emitting device according to the present embodiment is applicable as, but not particularly limited to, for example, an exposure head in an image forming apparatus such as a laser printer, etc. for irradiating a photosensitive drum with light to form a latent image thereon.

As illustrated in FIG. 1, a light-emitting device 10 according to the present embodiment includes a plurality of pixels 1, a plurality of pixel circuits 2, and a plurality of pixel block select circuits 3.

The plurality of pixels 1 are disposed on a long substrate not illustrated and aligned side by side in the longitudinal direction of the substrate. FIG. 1 illustrates the pixels 1 aligned in one line for the sake of simplicity. The pixels 1 may be aligned in two or more lines. Moreover, the plurality of pixels 1 may be disposed in a zigzag pattern to be staggered from each other along the direction of the line. As the substrate, a glass substrate, a silicon substrate, or the like are usable, for example. The length of the long substrate in the transverse direction is preferably 10 mm or shorter. Each pixel 1 includes an organic EL element which is a light-emitting element. Instead of an organic EL element, a different light-emitting element such for example as an inorganic EL element, e.g., a light-emitting diode (LED) may be used.

The plurality of pixel circuits 2 are disposed on the substrate and aligned side by side adjacently to and in parallel with the line of pixels 1. The pixel circuits 2 are configured to control drive current for the light-emitting elements of the pixels 1, and one pixel circuit 2 is connected to one pixel 1.

The plurality of pixels 1 and the plurality of pixel circuits 2 are divided into n pixel blocks PB (pixel blocks PB(1), PB(2), . . . , PB(*n*-1), and PB(n)) each including m pixels 1 and m pixel circuits 2. In FIG. 1, eight (m=8) pixels 1 and eight pixel circuits 2 constitute one block for simple explanation. The number of pixels which constitutes one block is not limited to eight.

Data signal lines through which to supply data signals inputted from an external circuit not illustrated are connected to the pixel circuits 2. The number of data signal lines corresponds to the number of pixels (m) in one pixel block. In the example of FIG. 1, there are eight data signal lines Vdata (data signal lines Vdata0 to Vdata7), and each data signal line Vdata is connected to one pixel circuit 2 in one pixel block PB. The pixel circuits 2 included in each pixel block PB are connected to respectively different data signal lines Vdata.

Each pixel block PB further includes a pixel block select circuit 3. The pixel block select circuit 3 is connected to the pixel circuits 2 in the corresponding pixel block PB through control signal lines P1, P2, and P3. Thus, control signals outputted from the pixel block select circuit 3 can be inputted into the pixel circuits 2 in the corresponding pixel block PB through the control signal lines P1, P2, and P3. The control signal lines P1, P2, and P3 are disposed along the direction in which the pixel circuits 2 are aligned, and pass through the region where the pixel circuits 2 are disposed.

More specifically, control signal lines P1(1), P2(1), and P3(1) are each connected as a common line to each pixel circuit 2 in the pixel block PB(1). Also, control signal lines P1(2), P2(2), and P3(2) are each connected as a common line to each pixel circuit 2 in the pixel block PB(2). Similarly, control signal lines P1(*n*-1), P2(*n*-1), and P3(*n*-1) are each connected as a common line to each pixel circuit 2 in the pixel block PB(*n*-1). Also, control signal lines P1(*n*), P2(*n*), and P3(*n*) are each connected as a common line to each pixel circuit 2 in the pixel block PB(n).

Note that while the present embodiment has illustrated the example where each pixel circuit 2 is driven with three control signals (control signals inputted through the control signal lines P1, P2, and P3), the number control signals may be any number. The number of control signals can be optionally changed in accordance with the number of pixels 1 included in each pixel block PB, for example.

A clock signal line CLK and control signal lines S1, S2, and S3 are connected to each pixel block select circuit 3. Thus, a clock signal CLK and control signals S1, S2, and S3 can be inputted into the pixel block select circuit 3 from an external control circuit not illustrated.

A start pulse signal line SP is connected to the pixel block select circuit 3 of the pixel block PB(1) so that a start pulse signal can be inputted thereinto from the external control circuit not illustrated. The pixel block select circuits 3 of the adjacent pixel blocks PB are connected to each other. Each pixel block select circuit 3 includes a shift register (not illustrated) formed therein. Thus, the start pulse signal inputted into the pixel block select circuit 3 of the pixel block PB(1) is transferred sequentially to the next pixel block select circuit 3 in accordance with the clock signal CLK. In the pixel block select circuit 3, logic gates therein perform logic operations with transfer pulses and control signals to generate P1, P2, and P3 control signals. The P1, P2, and P3 control signals are control signals configured to select the pixel block PB in the order starting from the pixel block PB(1) to the pixel block PB(n).

A power supply line VDD and a power supply line VSS are connected to all the pixel block select circuits 3 so that a power supply voltage can be supplied to the pixel block select circuits 3. Further, a power supply line VOLED is connected to all the pixel circuits 2 so that a power supply voltage can be supplied to the pixel circuits 2. Furthermore, a power supply line VOCOM is connected to all the pixels 1 so that a power supply voltage can be supplied to the pixels 1.

The data signal lines Vdata0 to Vdata7, the clock signal line CLK, the control signal lines S1, S2, and S3, the power supply line VDD, the power supply line VSS, the power supply line VOLED, and the power supply line VOCOM are connected to terminal portions not illustrated provided on the substrate. Note that if there are any other necessary power supply lines, signal lines, and the like, these and their terminal portions may be disposed as appropriate.

The pixel circuits 2 in each pixel block PB are divided into two groups, and a space 4 is provided between these two groups. In the example of FIG. 1, the eight pixel circuits 2 included in each pixel block PB are divided into two groups each including a half of the pixel circuits 2, i.e., four pixel circuits 2. The space 4 can be left between the groups by making the pitch at which the pixel circuits 2 are disposed in each group smaller than the pitch at which the pixels 1 are disposed. The width of the region between the groups (space 4) is larger than the interval between the pixel circuits 2 in each group.

The control signal lines P1, P2, and P3 and the pixel block select circuit 3 in each pixel block PB are connected to each other through lead portions led out from the control signal lines P1, P2, and P3 in a direction which crosses the control signal lines P1, P2, and P3. These lead portions and the control signal lines P1, P2, and P3 are connected to each other in the space 4. To put it differently, each of the control signal lines P1, P2, and P3 includes a first interconnection portion disposed to extend through the region of the pixel circuits 2 in the direction in which the pixel circuits 2 are aligned, and a second interconnection portion disposed to extend from the pixel block select circuit 3 to the inside of the region between the groups (space 4). Moreover, the first interconnection portion and the second interconnection portion are connected to each other at the region between the groups (space 4).

Connecting the control signal lines P1, P2, and P3 and the pixel block select circuit 3 in this manner can shorten the longest interconnection length between the pixel block select circuit 3 and the pixel circuit 2 as compared to a case where signals are caused to travel sequentially from the pixel circuit 2 at an end of the pixel block PB. For example, in the example of FIG. 1 where the eight pixel circuits 2 are divided into two groups of four pixel circuits 2, the distance of travel of control signals to the pixel circuit 2 at an end of the pixel block PB is half the distance of travel from the pixel circuit 2 at one end of the pixel block PB to the pixel circuit 2 at the other end thereof. Hence, it is possible to reduce the deformation of the waveforms of the control signals due to the parasitic impedances of the control signal lines P1, P2, and P3.

Next, an example of the configuration of each pixel circuit 2 in the light-emitting device according to the present embodiment will be described with reference to FIG. 2.

As illustrated in FIG. 2, each pixel circuit 2 includes a driving transistor M1, switch transistors M2, M3, M4, M5, M6, M7, and M8, and a holding capacitor C1. The switch transistor M3 is a transistor to be controlled by the P1 control signal and its gate is connected to the control signal line P1. The switch transistor M4 is a transistor to be controlled by the P2 control signal and its gate is connected to the control signal line P2. The switch transistors M2, M5, M6, M7, and M8 are transistors to be controlled by the P3 control signal and their gates are connected to the control signal line P3.

One of the source and drain of the switch transistor M7 is connected to the common power supply line VOLED. The other of the source and drain of the switch transistor M7 is connected to the source of the driving transistor M1, one of the source and drain of the switch transistor M8, and one of the source and drain of the switch transistor M5. The other of the source and drain of the switch transistor M5 is connected to the data signal line Vdata.

The other of the source and drain of the switch transistor M8 is connected to one of the terminals of the holding capacitor C1 and one of the source and drain of the switch transistor M2. The other of the source and drain of the switch transistor M2 is connected to a reference voltage line Vref.

The gate of the driving transistor M1 is connected to the other terminal of the holding capacitor C1, one of the source and drain of the switch transistor M3, and one of the source and drain of the switch transistor M4. The other of the source and drain of the switch transistor M3 is connected to a pre-charge voltage line Vini.

The drain of the driving transistor M1 is connected to the other of the source and drain of the switch transistor M4 and one of the source and drain of the switch transistor M6. The other of the source and drain of the switch transistor M6 is connected to the anode of an organic EL element EL. The cathode of the organic EL element EL is connected to the common power supply line VOCOM. Here, the organic EL element EL is a light-emitting element which constitutes the pixel 1.

Note that the reference voltage line Vref and the pre-charge voltage line Vini are not illustrated in FIG. 1 for the sake of simplicity.

Next, the operation of the light-emitting device according to the present embodiment will be described with reference to the timing chart in FIG. 3. The light-emitting device according to the present embodiment performs data writing such that the data writing is performed sequentially on all the pixel blocks on a pixel block basis. However, the following description will focus on the data writing operation for the pixel block PB(1) and the pixel block PB(2).

First, the description will be given for the pixel block PB(1). Note that while the following description will explain data writing to one pixel 1 in the pixel block PB(1), the data writing is performed on the plurality of pixels 1 in the pixel block PB(1) simultaneously through similar steps.

Immediately before a time to, a control signal P1(1), a control signal P2(1), and a control signal P3(1) are at Low (L) levels.

At the time t0, the control signal P3(1) shifts from the L level to an High (H) level. As a result, the switch transistors M6 and M7 switch from ON states to OFF states, so that the supply of current to the organic EL element EL stops. Also, the switch transistors M2 and M5 switch from OFF states to ON states, so that the source of the driving transistor M1 is connected to the data signal line Vdata and the one terminal of the holding capacitor C1 is connected to the reference voltage line Vref.

Also, at the time t0 again, the control signal P1(1) shifts from the L level to an H level. As a result, the switch transistor M3 switches from an OFF state to an ON state, so that the gate (illustrated as "M1–Vg(1)" in FIG. 3) of the driving transistor M1 is connected to the pre-charge voltage line Vini. Thus, gate-source voltage Vgs of the driving transistor M1 is $$Vgs=Vini-Vdata$$

and is set to a gate-source voltage that can drive a high current (pre-charge period).

Then, at a time t1, the control signal P1(1) shifts from the H level to the L level and the control signal P2(1) shifts from the L level to an H level. As a result, the switch transistor M3 switches from the ON state to the OFF state and the switch transistor M4 switches from an OFF state to an ON state.

Consequently, a current is supplied from the driving transistor M1 in accordance with the driving ability of the driving transistor M1, and gate voltage Vg of the driving transistor M1 rises until the gate-source voltage of the driving transistor M1 reaches a threshold voltage (Vth). Note that the gate voltage Vg of the driving transistor M1 in this step is $$Vg=Vdata-Vth.$$

Then, at a time t2, the control signal P2(1) shifts from the H level to the L level. As a result, the switch transistor M4 switches from the ON state to the OFF state, so that voltage dV1 between both terminals of the holding capacitor C1 is $$dV1=(Vdata-Vth)-Vref.$$

Specifically, the threshold voltage (Vth) of the driving transistor M1 and the data voltage are written at the same time to one holding capacitor C1 (auto-zero data writing period).

Also, at the time t2 again, the control signal P3(1) shifts from the H level to the L level. As a result, the switch transistors M2 and M5 switch from the ON states to the OFF states, and the switch transistors M6 and M7 switch from the OFF states and stay in the ON states until immediately before a time t7 at which the pixel circuit 2 is selected next time.

Consequently, a current path is formed which extends from the common power supply line VOLED through the switch transistor M7, the driving transistor M1, the switch transistor M6, and the organic EL element EL to the common power supply line VOCOM, and the supply of current to the organic EL element EL starts.

Here, the switch transistor M7 has an ON resistance. The common power supply voltage VOLED after a voltage drop of a voltage 5V, which is caused at the switch transistor M7 by this ON resistance in proportion to the amount of current therethrough, is source voltage Vs of the driving transistor M1. Thus, the source voltage Vs of the driving transistor M1 is $$Vs=VOLED-\delta V.$$

Meanwhile, since no current flows through the switch transistor M8, which is connected to the driving transistor M1, no voltage drop occurs due to the switch transistor M8. Thus, voltage Vc at the one terminal of the holding capacitor C1 is equal to the source voltage Vs of the driving transistor M1 (Vc=Vs).

Hence, the gate voltage Vg of the driving transistor M1 is $$Vg=Vc-dV1=Vs-dV1.$$

Then, the gate-source voltage Vgs of the driving transistor M1 is $$Vgs=Vg-Vs=dV1=(Vdata-Vth)-Vref \quad (1)$$

Thus, a current proportional to the gate-source voltage Vgs of the driving transistor M1 is supplied to the organic EL element EL from the driving transistor M1, and the organic EL element EL emits an amount of light in accordance with the value of the supplied current (light emission period).

Next, the description will be given for the pixel block PB(2). Note that the following description will be given for one pixel in the pixel block PB(2), but the plurality of pixels in the pixel block PB(2) are driven simultaneously through similar steps.

Immediately before the time t2, a control signal P1(2), a control signal P2(2), and a control signal P3(2) are at L levels.

At the time t2, the control signal P3(2) shifts from the L level to an H level. As a result, the switch transistors M6 and M7 switch from ON states to OFF states, so that the supply of current to the organic EL element EL stops. Also, the switch transistors M2 and M5 switch from OFF states to ON states, so that the source of the driving transistor M1 is connected to the data signal line Vdata and the one terminal of the holding capacitor C1 is connected to the reference voltage line Vref.

Also, at the time t2 again, the control signal P1(2) shifts from the L level to an H level. As a result, the switch transistor M3 switches from an OFF state to an ON state, so that the gate of the driving transistor M1 is connected to the pre-charge voltage line Vini. Thus, the gate-source voltage Vgs of the driving transistor M1 is $$Vgs=Vini-Vdata$$

and is set to a gate-source voltage that can drive a high current (pre-charge period).

After this, similarly to the pixel block PB(1), the operation goes sequentially through an auto-zero data writing period and a light emission period.

The pre-charge period, the auto-zero data writing period, and the light emission period are repeated as described above for each pixel block PB.

As mentioned in the above description of the operation, the control signal P1 is a signal for controlling the pre-charge period, the control signal P2 is a signal for controlling the auto-zero data writing period (a signal for controlling the duration of data writing), and the control signal P3 is a signal for controlling the light emission period. More specifically, the control signal P2 is for controlling the duration of correction of the threshold voltage of the driving transistor M1 and the control signal P3 is for controlling the duration of light emission, and they are particularly important for accurately controlling the amount of current to be flowed into the organic EL element EL.

According to the light-emitting device 10 of the present embodiment, as described above, the longest interconnection length between the pixel block select circuit 3 and the pixel circuit 2 can be shortened as compared to the case where signals are caused to travel sequentially from the pixel circuit 2 at an end of the pixel block PB. In this way, it is possible to reduce the deformation of the waveforms of the control signals due to the parasitic impedances of the control signal lines P1, P2, and P3.

Thus, the light-emitting device 10 of the present embodiment, which is capable of effectively reducing the deformation of the waveforms of the control signal P1, control signal P2, and control signal P3, is significantly advantageous in accurately controlling the amount of current to be flowed into the organic EL element EL.

Thus, according to the present embodiment, it is possible to reduce the deformation of the waveforms of the signals due to the parasitic impedances of the control signal lines, and thus to accurately control the amount of current to be flowed to the organic EL element of each pixel. Hence, a light-emitting device capable of accurately controlling the amount of light emission can be realized.

Second Embodiment

Figure 4:
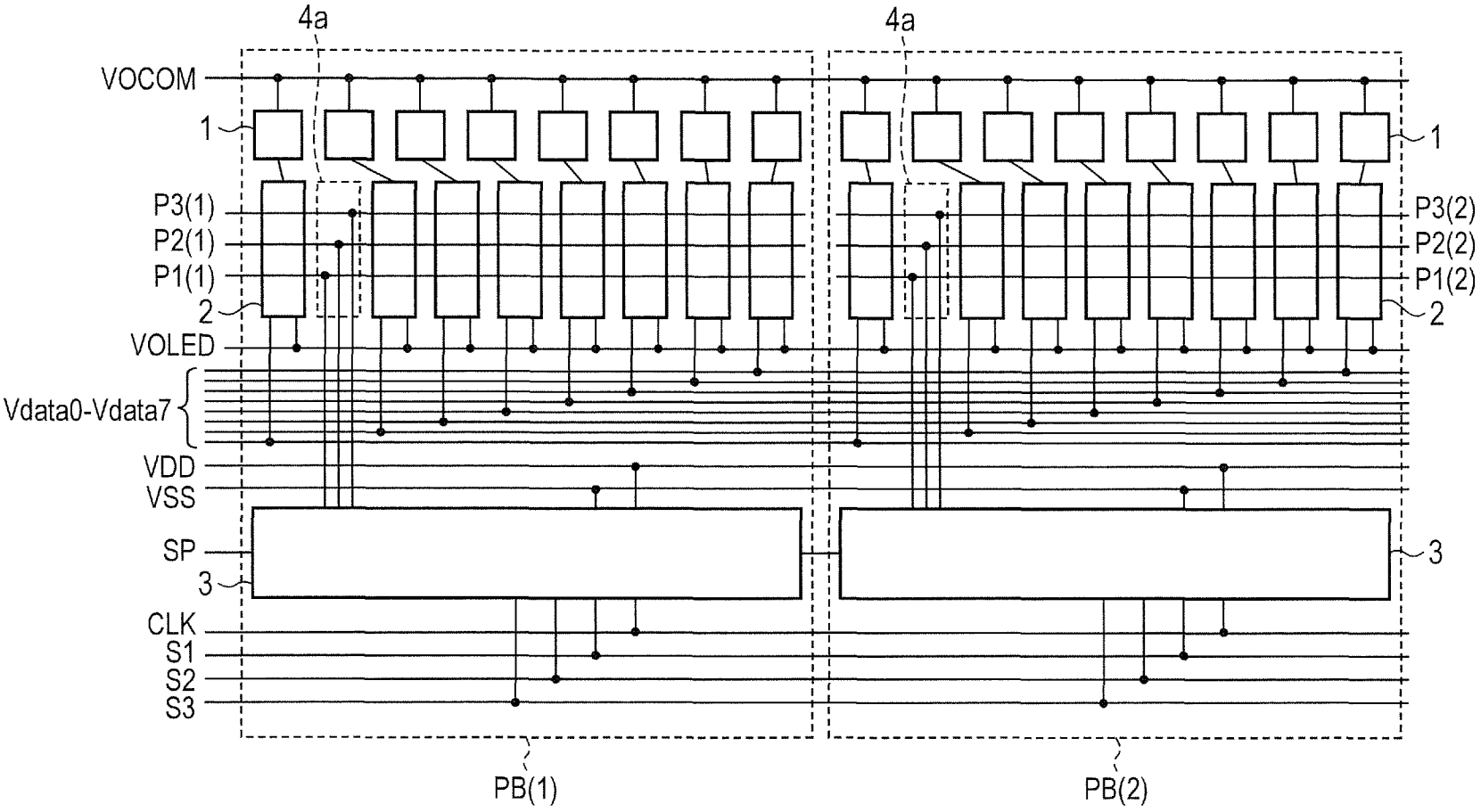
FIG. 4 is a schematic diagram illustrating the configuration of a light-emitting device according to a second embodiment of the present invention.

A light-emitting device according to a second embodiment of the present invention will be described with reference to FIG. 4. FIG. 4 is a schematic diagram illustrating the configuration of the light-emitting device according to the present embodiment. Constituent components similar to those of the light-emitting device according to the first embodiment, which are illustrated in FIGS. 1 to 3, will be denoted by the same reference signs, and will not be described or will be described briefly.

In the present embodiment, only the difference from the light-emitting device according to the first embodiment, which is illustrated in FIG. 1, will be described. Note that FIG. 4 only illustrates a pixel block PB(1) and a pixel block PB(2) among n pixel blocks PB for the sake of simplicity.

In the light-emitting device according to the first embodiment, the plurality of pixel circuits 2 included in each pixel block PB are divided into two groups each including a half of the pixel circuits, and the space 4 is left between these groups for a contact portion of the control signal lines P1, P2, and P3. However, the arrangement of the contact portion (space 4) of the control signal lines P1, P2, and P3 is not necessarily limited to such an arrangement. In other words, when the plurality of pixel circuits 2 are divided into two groups, they do not necessarily have to be divided into groups each including a half of the pixel circuits 2.

In the light-emitting device illustrated in FIG. 4, the pixel circuits 2 are divided by a space 4*a* into a group including one pixel circuit 2 and a group including seven pixel circuits 2. In this case, too, the longest interconnection length between the pixel block select circuit 3 and the pixel circuit 2 can be shortened as compared to the case where signals are caused to travel sequentially from the pixel circuit 2 at an end of the pixel block PB. Thus, the light-emitting device according to the present embodiment can also reduce the deformation of the waveforms of the control signals due to the parasitic impedances of the control signal lines P1, P2, and P3.

As described above, according to the present embodiment, it is possible to reduce the deformation of the waveforms of the signals due to the parasitic impedances of the control signal lines, and thus to accurately control the amount of current to be flowed to the organic EL element of each pixel. Hence, a light-emitting device capable of accurately controlling the amount of light emission can be realized.

Third Embodiment

Figure 5:
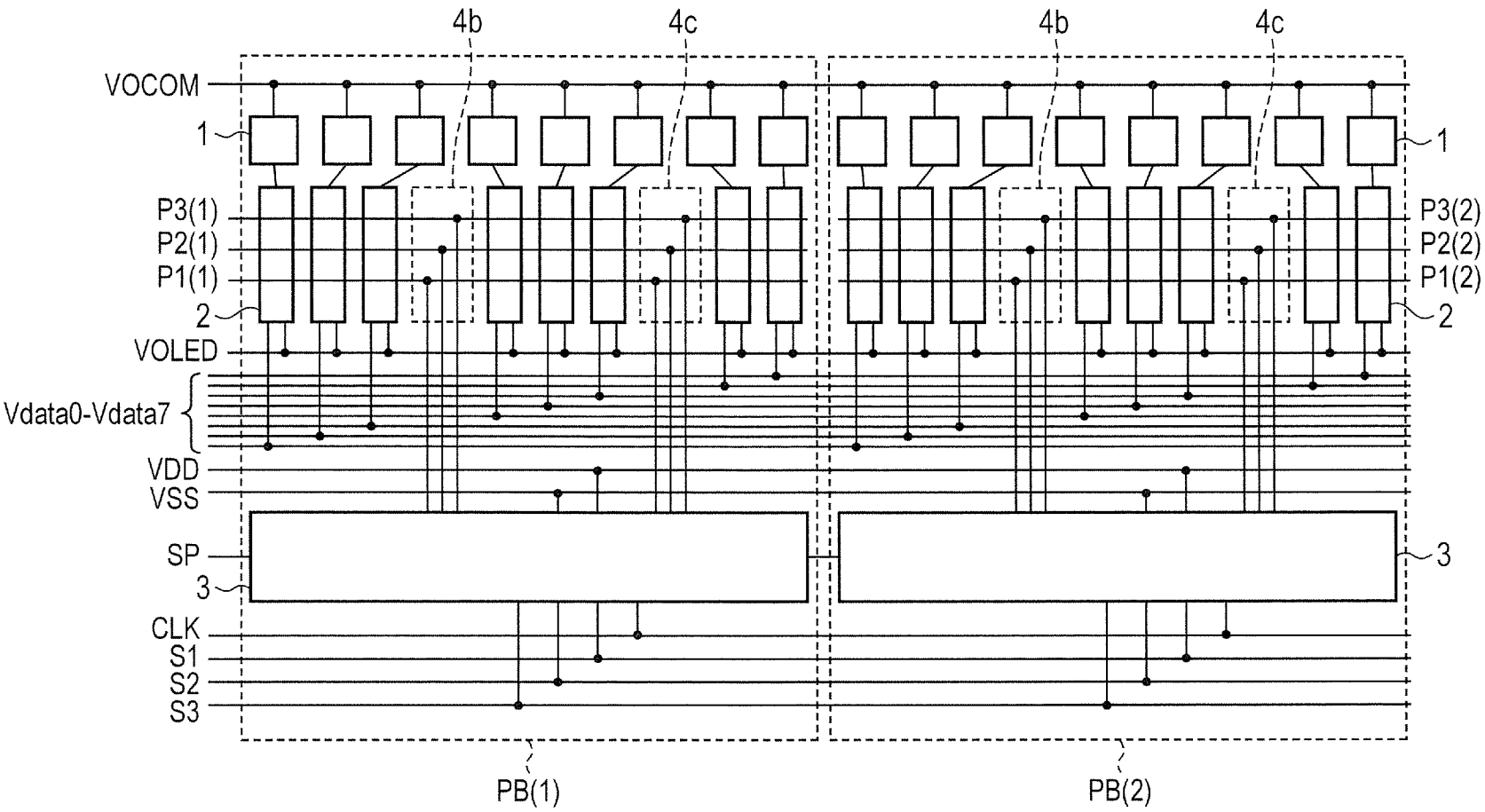
FIG. 5 is a schematic diagram illustrating the configuration of a light-emitting device according to a third embodiment of the present invention.

A light-emitting device according to a third embodiment of the present invention will be described with reference to FIG. 5. FIG. 5 is a schematic diagram illustrating the configuration of the light-emitting device according to the present embodiment. Constituent components similar to those of the light-emitting devices according to the first and second embodiments, which are illustrated in FIGS. 1 to 4, will be denoted by the same reference signs, and will not be described or will be described briefly.

In the present embodiment, only the difference from the light-emitting devices according to the first and second embodiments, which are illustrated in FIGS. 1 and 4, will be described. Note that FIG. 5 only illustrates a pixel block PB(1) and a pixel block PB(2) among n pixel blocks PB for the sake of simplicity.

In the first and second embodiments, the plurality of pixel circuits 2 included in each pixel block PB are divided into two groups. However, the pixel circuits 2 do not necessarily have to be divided into two groups and may be divided into three or more groups.

In the light-emitting device illustrated in FIG. 5, the plurality of pixel circuits 2 included in each pixel block PB are divided into three groups by a space 4*b* and a space 4*c*. Moreover, in each of the spaces 4*b* and 4*c*, lead portions are disposed which extend from the control signal lines P1, P2, and P3 to the pixel block select circuit 3. The same signals are outputted to the lead portions in each of the spaces 4*b* and 4*c*.

In the case where the plurality of pixel circuits 2 included in each pixel block PB are divided into three or more groups and two or more contact portions are disposed, the control signal lines P1, P2, and P3 do not necessarily have to be common to all the pixel circuits 2. For example, in FIG. 5, the control signal lines P1, P2, and P3 may each be divided into two, right and left lines between the space 4*b* and the pixel circuit 2 to the right thereof.

Dividing the plurality of pixel circuits 2 included in each pixel block PB into three or more groups can further shorten the longest interconnection length between the pixel block select circuit 3 and the pixel circuit 2 as compared to the case where the pixel circuits 2 are divided into two groups. Hence, the light-emitting device according to the present embodiment can further reduce the deformation of the waveforms of the control signals due to the parasitic impedances of the control signal lines P1, P2, and P3.

Thus, according to the present embodiment, it is possible to reduce the deformation of the waveforms of the signals due to the parasitic impedances of the control signal lines, and thus to accurately control the amount of current to be flowed to the organic EL element of each pixel. Hence, a light-emitting device capable of accurately controlling the amount of light emission can be realized.

Fourth Embodiment

Figure 6:
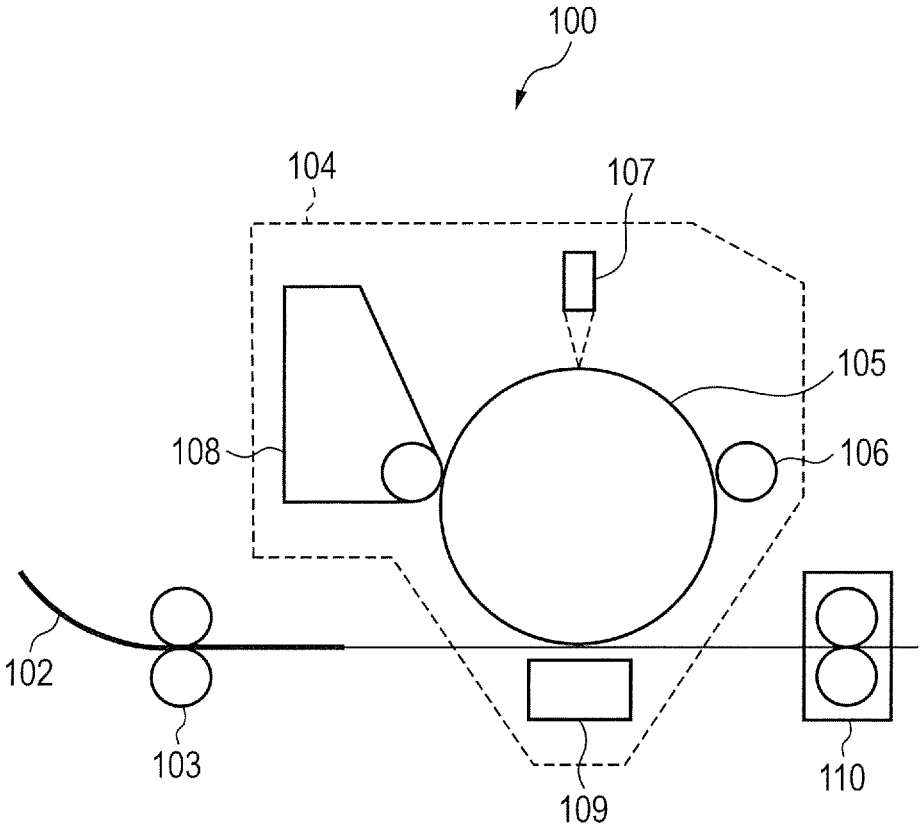
FIG. 6 is a schematic diagram illustrating the configuration of an image forming apparatus according to a fourth embodiment of the present invention.

An image forming apparatus according to a fourth embodiment of the present invention will be described with reference to FIG. 6. FIG. 6 is a schematic diagram illustrating the configuration of the image forming apparatus according to the present embodiment.

In the present embodiment, an image forming apparatus which uses the light-emitting device according to any of the first to third embodiments as an exposure head will be described.

First, the configuration of the image forming apparatus according to the present embodiment will be described with reference to FIG. 6.

As illustrated in FIG. 6, an image forming apparatus 100 according to the present embodiment includes a recording unit 104 including a photosensitive drum 105, a charger 106, an exposure head 107, a developing device 108, and a transfer device 109, conveyance rollers 103, and a fixing device 110. The light-emitting device 10 according to any of the first to third embodiments is used as the exposure head 107. The exposure head 107 (light-emitting device 10) is disposed with the plurality of pixels 1 disposed along the axial direction of the photosensitive drum 105.

Next, the operation of the image forming apparatus according to the present embodiment will be described.

In the recording unit 104, the surface of the cylindrical photosensitive drum 105, which is a photosensitive member, is electrically charged uniformly with the charger 106, which is a charging unit.

Then, the exposure head 107, which is an exposure unit, is caused to emit light in accordance with data to expose the photosensitive drum 105 to the light, so that an electrostatic latent image corresponding to the data by the exposure is formed on the photosensitive drum 105. The formation of the electrostatic latent image can be controlled through the amount of light emission (illuminance and duration) by the exposure head 107.

Next, in the recording unit 104, the developing device 108, which is a developing unit, applies a toner, which is a developing agent, onto the photosensitive drum 105 so that the toner can adhere to the electrostatic latent image, and the transfer device 109 transfers the toner, which has adhered to the electrostatic latent image, onto a paper sheet 102.

The fixing device 110 fixes the toner to the paper sheet 102, onto which image data has been transferred through the recording unit 104, and the paper sheet 102 is then discharged. Note that the timing at which the paper sheet 102 is conveyed to the record system 104 by the conveyance rollers 103 can be set as appropriate.

The present embodiment has been described by taking, as an example, a monochrome image forming apparatus with one recording unit 104. However, the image forming apparatus 100 is not limited to such an apparatus and may be a color image forming apparatus including a plurality of the recording units 104.

As described above, according to the present embodiment, the image forming apparatus is formed using the light-emitting device according to any of the first to third embodiments. Hence, an image forming apparatus capable of fine image formation can be realized.

[Modifications]

The present invention is not limited to the above embodiments, and various modifications are possible.

For example, the pixel circuit illustrated in FIG. 2 in the above first embodiment is an example, and a different pixel circuit configuration can be employed instead. One of the characteristic features of the present invention lies in how the pixel circuits 2 and the pixel block select circuit 3 are connected to each other, and the present invention is not limited to the internal configuration of the pixel circuits 2.

For example, the control signal lines (P1, P2, P3) do not necessarily have to be three lines and the number of control signal lines may be increased or decreased as appropriate in accordance with the circuit configuration of the pixel circuits 2.

Moreover, the arrangement of each circuit element in relation to the other circuit elements in FIGS. 1, 4, and 5 is an example and is not limited thereto. For example, in FIGS. 1, 4, and 5, the data signal lines Vdata may be disposed above the common power supply line VOCOM.

Also, while the contact portions of the control signal line P1, control signal line P2, and control signal line P3 are disposed in the same space 4 in the above first to third embodiments, they may be disposed in different spaces 4. For example, in FIG. 5, the contact portions of the control signal line P1 and control signal line P2 may be disposed in the space 4*b* and the contact portion of the control signal line P3 may be disposed in the space 4*c*. Alternatively, the contact portions of the control signals P1, P2, and P3 may be disposed in respectively different spaces.

Also, while the plurality of pixels 1 and the plurality of pixel circuits 2 are divided into the plurality of pixel blocks PB in the above first to third embodiments, they do not necessarily have to be divided in a plurality of pixel blocks.

Also, the image forming apparatus in the above fourth embodiment is shown as one exemplary apparatus to which the light-emitting devices according the first to third embodiments are applicable, and apparatuses to which the light-emitting devices according the first to third embodiments are applicable are not limited to such an apparatus. The light-emitting devices according to the first to third embodiments are applicable to various apparatuses which use a light source with light-emitting elements aligned side by side.

The above embodiments are mere illustration of some possible modes of application of the present invention and are not intended to prevent the present invention from being corrected and/or modified as appropriate without departing from the spirit of the present invention.

According to the present invention, it is possible to reduce the deformation of the waveforms of the signals due to the parasitic impedances of the control signal lines, and thus to accurately control the amount of current to be flowed to the organic EL element of each pixel. Hence, a light-emitting device capable of accurately controlling the amount of light emission can be realized. Moreover, by using such a light-emitting device, an image forming apparatus capable of fine image formation can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-163369, filed on Aug. 11, 2014 which is hereby incorporated by reference herein in its entirety.

What is claimed is:

1. A light-emitting device comprising:

a pixel block including:

(a) a plurality of light-emitting elements disposed on a long substrate and aligned in a longitudinal direction of the substrate, (b) a plurality of pixel circuits respectively connected to the plurality of light-emitting elements, (c) a control signal line connected to the plurality of pixel circuits, and (d) a pixel block select circuit connected to the control signal line and configured to output a control signal to the plurality of pixel circuits, wherein the plurality of pixel circuits are divided into a plurality of groups, wherein the control signal line includes a first interconnection portion and a second interconnection portion, wherein the first interconnection portion is disposed along the longitudinal direction of the substrate and is connected to the plurality of pixel circuits, wherein the second interconnection portion is disposed in a region between the plurality of groups and is connected to the pixel block select circuit, wherein the first interconnection portion and the second interconnection portion are connected to each other in the region between the plurality of groups, and wherein a distance, in the longitudinal direction of the substrate, between the plurality of pixel circuits is smaller than a distance, in the longitudinal direction of the substrate, between the plurality of light-emitting elements.

2. The light-emitting device according to claim 1, wherein the light-emitting device comprises a plurality of the pixel blocks, and wherein data writing is performed sequentially on the plurality of the pixel blocks on a pixel block basis.

3. The light-emitting device according to claim 1, wherein a width of the region, in the longitudinal direction of the substrate, between the plurality of groups is larger than an interval, in the longitudinal direction of the substrate, between the pixel circuits in each of the plurality of groups.

4. The light-emitting device according to claim 1, wherein the pixel block select circuit outputs, to the plurality of pixel circuits, any one of a signal which controls a duration of data writing and a signal which controls a duration of light emission.

5. The light-emitting device according to claim 1, wherein a length of the substrate in the transverse direction is 10 mm or less.

6. An image forming apparatus comprising:

a photosensitive member;

an exposure unit configured to expose the photosensitive member to light;

a charging unit configured to electrically charge the photosensitive member; and a developing unit configured to apply a developing agent onto the photosensitive member, wherein the exposure unit includes a light-emitting device including a pixel block including:

(a) a plurality of light-emitting elements disposed on a long substrate and aligned in a longitudinal direction of the substrate, (b) a plurality of pixel circuits respectively connected to the plurality of light-emitting elements, (c) a control signal line connected to the plurality of pixel circuits, and (d) a pixel block select circuit connected to the control signal line and configured to output a control signal to the plurality of pixel circuits, wherein the plurality of pixel circuits are divided into a plurality of groups, wherein the control signal line includes a first interconnection portion and a second interconnection portion, wherein the first interconnection portion is disposed along the longitudinal direction of the substrate and is connected to the plurality of pixel circuits, wherein the second interconnection portion is disposed in a region between the plurality of groups and is connected to the pixel block select circuit, wherein the first interconnection portion and the second interconnection portion are connected to each other in the region between the plurality of groups, wherein a distance, in the longitudinal direction of the substrate, between the plurality of pixel circuits is smaller than a distance, in the longitudinal direction of the substrate, between the plurality of light-emitting elements, and wherein the plurality of light-emitting elements are disposed side by side in an axial direction of the photosensitive member.

7. An image forming apparatus comprising:

a photosensitive member;

an exposure unit configured to expose the photosensitive member to light;

a charging unit configured to electrically charge the photosensitive member; and a developing unit configured to apply a developing agent onto the photosensitive member, wherein the exposure unit includes a light-emitting device including a pixel block including:

(a) a plurality of light-emitting elements disposed on a long substrate and aligned in a longitudinal direction of the substrate, (b) a plurality of pixel circuits respectively connected to the plurality of light-emitting elements, (c) a control signal line connected to the plurality of pixel circuits, and (d) a pixel block select circuit connected to the control signal line and configured to output a control signal to the plurality of pixel circuits, wherein the plurality of pixel circuits are divided into a plurality of groups, wherein the control signal line includes a first interconnection portion and a second interconnection portion, wherein the first interconnection portion is disposed along the longitudinal direction of the substrate and is connected to the plurality of pixel circuits, wherein the second interconnection portion is disposed in a region between the plurality of groups and is connected to the pixel block select circuit, wherein the first interconnection portion and the second interconnection portion are connected to each other in the region between the plurality of groups, wherein a distance, in the longitudinal direction of the substrate, between the plurality of pixel circuits is smaller than a distance, in the longitudinal direction of the substrate, between the plurality of light-emitting elements, wherein a width of the region between the plurality of groups is larger than an interval between the pixel circuits in each of the plurality of groups, and wherein the plurality of light-emitting elements are disposed side by side in an axial direction of the photosensitive member.

* * * * *